United States Patent [19]

Peterman

[11] Patent Number: 4,618,191

[45] Date of Patent: Oct. 21, 1986

[54] ANTI-TIP DEVICE

[75] Inventor: Robert J. Peterman, Hartland, Wis.

[73] Assignee: Spacesaver Corporation, Fort Atkinson, Wis.

[21] Appl. No.: 694,847

[22] Filed: Jan. 25, 1985

[51] Int. Cl.[4] ..... B61F 9/00; A47B 53/00

[52] U.S. Cl. ..... 312/201; 312/250; 104/248

[58] Field of Search ..... 312/250, 198, 199, 201, 312/333, 301; 104/248

[56] References Cited

U.S. PATENT DOCUMENTS

| | | | |
|---|---|---|---|
| 535 | 12/1837 | Kinkead | 104/248 |
| 233,016 | 10/1880 | Powers | 104/248 |
| 2,273,705 | 2/1942 | Guerrero | 104/248 |
| 3,080,826 | 3/1963 | Nelson et al. | 104/248 |
| 3,311,067 | 3/1967 | Gretzschel et al. | 104/248 |
| 3,967,868 | 7/1976 | Baker | 312/250 |

FOREIGN PATENT DOCUMENTS

| | | | |
|---|---|---|---|
| 1233393 | 5/1971 | United Kingdom | 312/250 |

*Primary Examiner*—William E. Lyddane
*Assistant Examiner*—Gerald A. Anderson
*Attorney, Agent, or Firm*—Fuller, House & Hohenfeldt

[57] ABSTRACT

An anti-tip device is useful for preventing a mobile storage system movable carriage from tipping. The anti-tip device includes an arm pivotable between inoperative and operative modes. In the inoperative mode, the arm hangs in an open position to permit the carriage to be placed on the system rails. With the carriage on the rails, the arm is pivotable to the operative mode wherein a hook on the arm slidingly engages an undercut surface of a longitudinal groove in the rail. The arm is pinned to the carriage when in the operative mode. A tipping force is resisted by contact between the pinned arm hook and the rail undercut surface.

11 Claims, 5 Drawing Figures

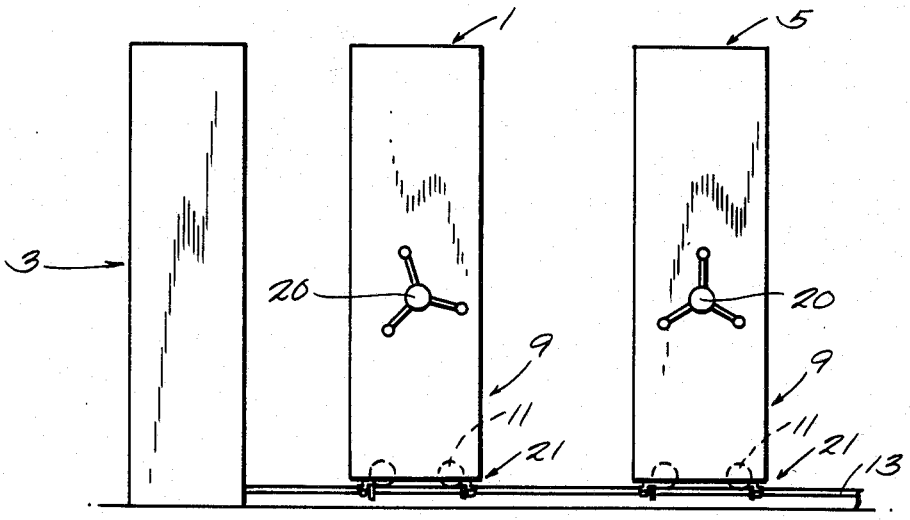
Fig. 1
Fig. 2
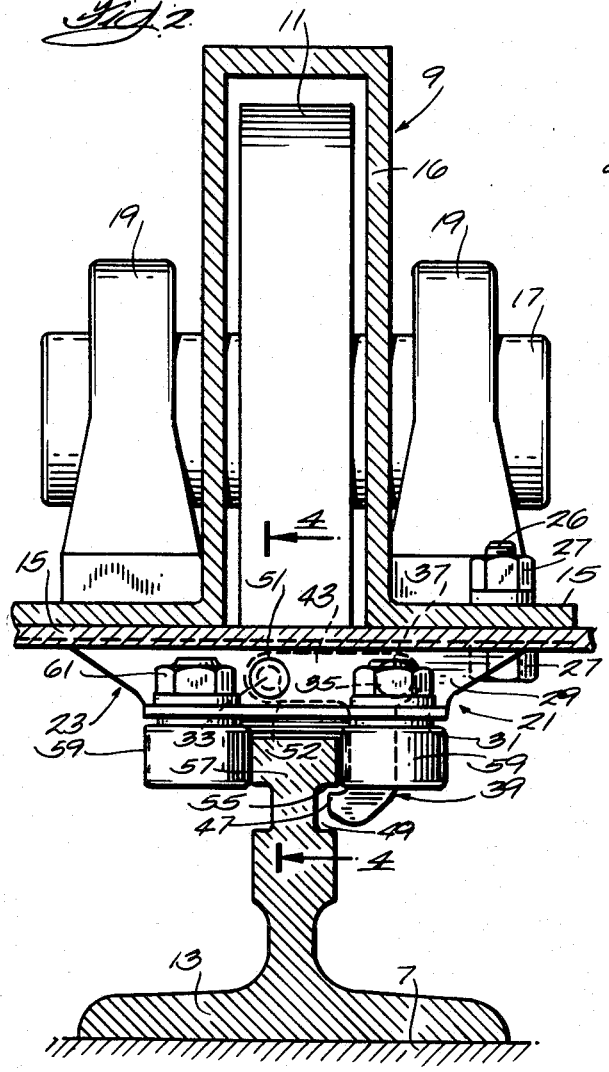
Fig. 3
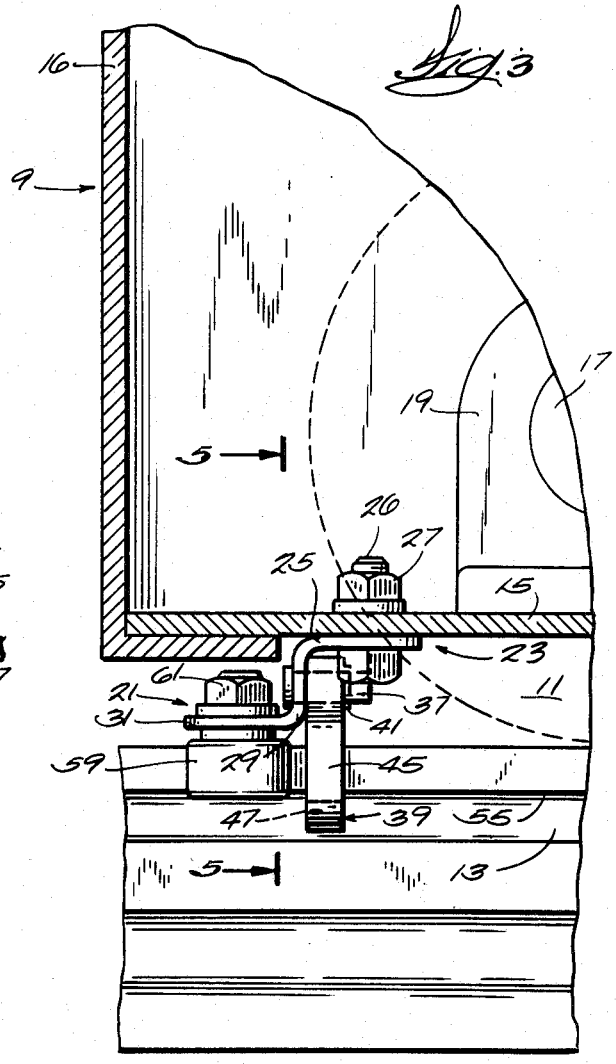

ANTI-TIP DEVICE

BACKGROUND OF THE INVENTION

1. Field of the Invention

This invention pertains to safety apparatus, and more particularly to apparatus for preventing a movable carriage from tipping under the influence of an overturning force.

2. Description of the Prior Art

It is well known to employ mobile filing and storage systems in buildings in order to conserve expensive floor space. For example, movable book shelves are commonly installed in libraries and offices. A mobile storage system normally includes various combinations of stationary and movable storage units. A typical movable storage unit comprises a carriage mounted on wheels which roll longitudinally along rails embedded in the building floor. The carriage is usually quite high and deep, but it is quite narrow in the direction of longitudinal movement along the rails. Consequently, the carriage is relatively unstable in the directions of motion, particularly if it is eccentrically loaded near the top.

To increase the stability of a mobile storage system carriage, the carriage frame may be designed to maximize the longitudinal spread between the support wheels. Even with the maximum spread between the wheels, it is still possible for a carriage to tip under certain unusual circumstances. For instance, tipping is possible if a wheel of a top-heavy moving carriage strikes an object on a rail; the inertia of the carriage and stored materials may cause the carriage to tip.

Certain devices are known which prevent longitudinal tipping. Such devices employ a keeper plate of some type which is fastened to the carriage and which slides under an elongated restraining bar or similar piece fastened to the rail. Prior devices suffer two major handicaps. The first is that the separate piece or bar fixed to the rail entails undesirable material and assembly expense. Secondly, prior keeper plates are difficult and costly to assemble to the carriage in accurate alignment with the rail bar.

Thus, a need exists for a mobile storage system anti-tip device which is quickly and accurately mounted to the movable carriage and aligned with the fixed rails.

SUMMARY OF THE INVENTION

In accordance with the present invention, inexpensive apparatus is provided for positively preventing the tipping of a mobile storage system carriage which is efficiently mounted to the carriage and simultaneously aligned with the system rails. This is accomplished by apparatus which includes an anti-tip arm adapted to slide within a longitudinal groove in the system rail in conjunction with guiding means for transversely guiding the carriage along the rails.

The anti-tip arm is mounted in a guide bearing bracket which is permanently fastened to the carriage frame. The bracket is adapted to receive a pair of guide rollers, with one guide roller on each side of the rail to transversely guide the carriage as it moves longitudinally along the rails. The bracket further serves as a mounting member for the pivotable anti-tip arm. The anti-tip arm is mounted in the bracket in an accurately fixed relationship to the guide rollers, so that when the bracket is adjusted on the carriage frame for properly locating the guide rollers to guide the carriage, the anti-tip arm is automatically properly located relative to the rail groove. Thus, the combination of the anti-tip arm and guide rollers in one integral assembly assures accurate alignment of the arm within the rail groove.

The anti-tip arm is formed with a hook which slides in the rail groove. Should an unusual combination of conditions occur which could cause the carriage to tip, the anti-tip arm hook immediately engages the rail groove undercut surface, thereby preventing tipping.

Further in accordance with the present invention, the anti-tip arm is pivotable within the bearing guide bracket in a manner which permits placing the carriage on the rails with the bearing guide bracket and anti-tip arm assembled to the carriage. For that purpose, the anti-tip device includes a locking pin for selectively preventing or permitting the anti-tip arm to pivot relative to the bearing guide bracket. When the pin is disengaged from the anti-tip arm and bearing guide bracket, the anti-tip arm swings to an open and inoperative position whereby it passes over the rail for easy placement of the carriage on the rails. With the carriage in place on the rails, the anti-tip arm is pivoted so that the hook thereof enters the rail groove, and the locking pin is then inserted through aligned apertures in the anti-tip arm and bearing guide bracket to prevent anti-tip arm rotation and carriage tipping. Thus, installation of a mobile storage carriage employing the present invention is very simple, as it merely requires insertion of the locking pin to render the anti-tip device operational after the carriage is on the rails.

Other objects and advantages of the invention will become apparent to those skilled in the art from the disclosure.

BRIEF DESCRIPTION OF THE DRAWINGS

FIG. 1 is a side view of a mobile storage system which advantageously utilizes the present invention;

FIG. 2 is an enlarged sectional view taken along lines 2—2 of FIG. 1;

FIG. 3 is a side view, partially in section, taken along lines 3—3 of FIG. 2;

DETAILED DESCRIPTION OF THE INVENTION

Figure 5:
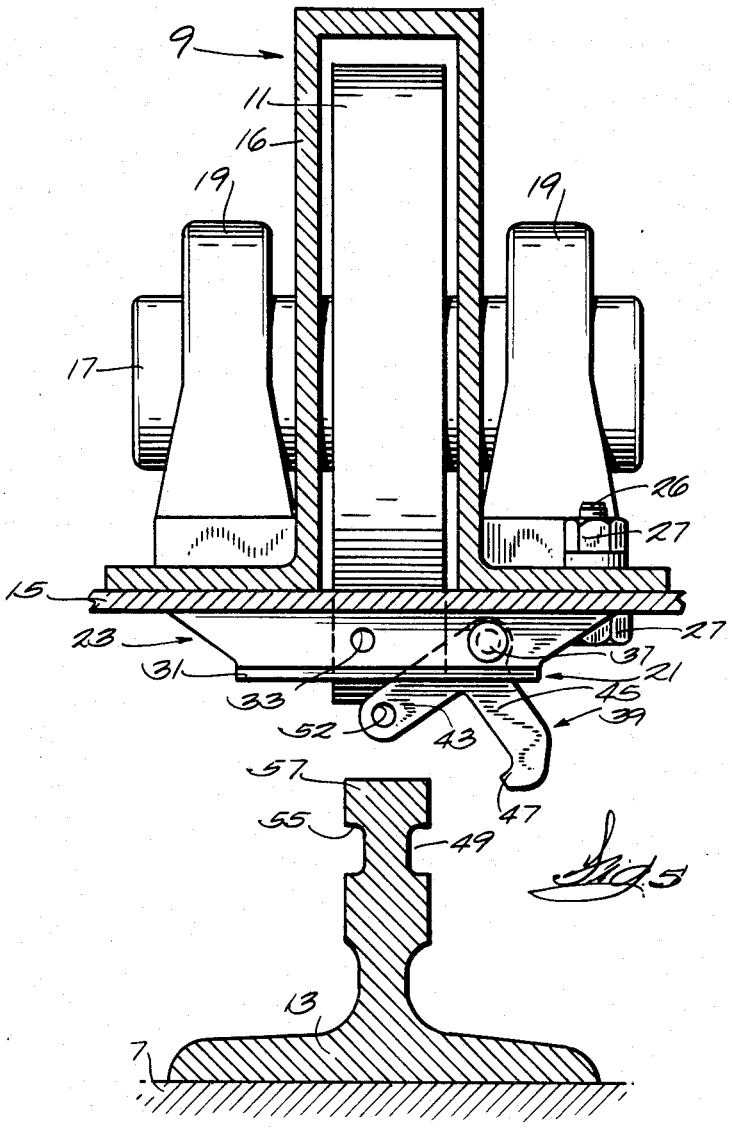
FIG. 5 is a sectional view taken generally along lines 5—5 of FIG. 3, but showing the anti-tip device of the present invention in the inoperative mode for placing a mobile storage system carriage on a rail.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Referring to FIG. 1, a mobile storage system 1 is illustrated which includes the present invention. Mobile storage systems find particular usefulness in libraries and offices for storing books, files, and similar materials. However, it will be understood that the invention is not limited to movable material storage applications.

The mobile storage system 1 typically includes one or more stationary units 3 and one or more movable units 5. The stationary units 3 are permanently anchored to the building floor 7 by any suitable means. Each movable unit 5 includes a carriage assembly 9 supported by a plurality of wheels 11 for longitudinal movement along two or more parallel rails 13 firmly embedded in the floor 7.

Referring to FIGS. 2 and 3, the carriage 9 comprises various horizontal and vertical frame members 15 and 16, respectively, which may be designed and manufactured in known fashion. To support the carriage on the rails 13, each wheel 11 includes an axle 17 fixed thereto and mounted for rotation within a pair of conventional pillow blocks 19 which are secured to the frame members 15 in any suitable manner. It will be understood that the several carriage wheel support assemblies are substantially identical. At least one wheel of each movable unit 5 is usually powered for longitudinal motion along the rails by known manual or electric means, as, for example, by a manual hand wheel 20 in conjunction with a chain and sprocket drive, not shown, suitably connecting a selected axle 17 with the hand wheel 20, FIG. 1.

Figure 4:
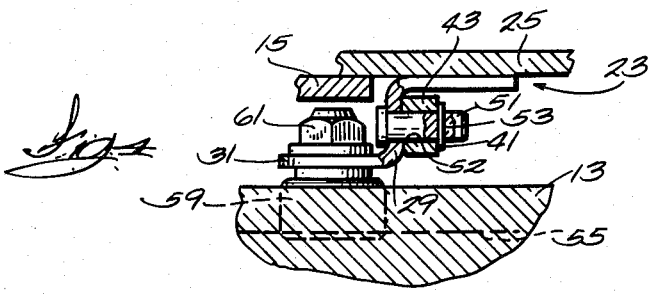
FIG. 4 is a sectional view taken along lines 4—4 of FIG. 2.

In accordance with the present invention, each movable storage unit 5 includes two or more anti-tip devices 21 which positively prevent the movable storage unit from tipping under extreme operating conditions. Preferrably, an anti-tip device 21 is employed with each wheel 11. Referring to FIGS. 2–4, the anti-tip device comprises a generally Z-shaped bearing guide bracket 23 which is formed with a first horizontal base portion 25. Conventional screws and nuts 26 and 27, respectively, may be utilized to secure the bearing guide bracket to the frame. Extending at generally right angles from bracket base 25 is a vertical leg portion 29, which connects with a second horizontal ledge portion 31. The bracket leg portion 29 defines a pair of apertures 33 and 35 having longitudinal axes generally parallel to the direction of motion of the carriage 9. Aperture 35 receives a headed pivot pin 37. Pivotally mounted over the pivot pin 37 is a generally L-shaped anti-tip arm 39. The anti-tip arm 39 and pivot pin are permanently retained on the bearing guide bracket, as, for example, by a conventional snap ring 41.

The anti-tip arm 39 includes a first extension 43 and a second extension 45 generally perpendicular to the first extension. As illustrated in FIG. 2, the pivot pin 37 passes through the anti-tip arm in the region of the junction of the extensions 43 and 45. The lower end of the second extension is fabricated with a hook 47. When the anti-tip device 21 is in the operative mode, the hook 47 slides within a groove 49 formed in the side of the rail 13.

To maintain the anti-tip arm 39 in the operative mode, as shown in FIG. 2, a locking pin 51 is inserted through an aperture 52 near the end of the first extension 43 when aperture 52 is aligned with the base aperture 33. See FIG. 4. The locking pin 51 is designed to be easily inserted into and removed from the arm 39 and bracket 23. Accordingly, the end of the pin may be adapted to hold a stainless steel ball 53, the surface of which protrudes slightly above the peripheral surface of the pin. With the pin 51 in place, as shown in FIG. 2, the anti-tip arm is in the operative mode, and overturning of the movable unit 5 is prevented by the hook 47 bearing against an undercut reaction surface 55 of the rail groove 49.

It is a feature of the present invention that the anti-tip device 21 may be assembled to the carriage 9 prior to placing the carriage on the rails 13. For that purpose, locking pin 51 is not inserted through the bearing guide bracket aperture 33 and extension aperture 52 during the assembly of the carriage. Consequently, as shown in FIG. 5, the arm 39 hangs in an inoperative open position with the extensions 43 and 45 at an angle to the horizontal and vertical. In that condition, the fully assembled carriage may be lowered onto the rails, and the hook 47 clears the rail top section 57 which lies above the groove 49. After the wheels 11 have been properly placed on the rails, it is a simple matter to swing the arm clockwise as viewed in FIG. 5 about pin 37 until pin 51 is insertable in bracket aperture 33 through aligned arm aperture 52. To remove the carriage from the rails it is necessary merely to pull the pin 51 from the aperture 33, and gravity will swing the arm hook 47 out of the groove 49.

Further in accordance with the present invention, the anti-tip device 21 is automatically aligned with the rail groove 49 when the carriage 9 is aligned to the rail 13. That is accomplished by incorporating a pair of guide rollers 59 into the anti-tip device, FIGS. 2 and 3, in an accurate and fixed relationship relative to the pivot pin 37. The guide rollers 59 are attached, as by nuts 61, to the guide bracket ledge 29 so as to straddle the rail top section 57 when the carriage is placed on the rail with only slight clearance between the roller peripheries and the rail.

To properly align the carriage 9 and wheels 11 on a rail 13 by means of the guide rollers 59, the bearing guide bracket 23 is adjustable transversely relative to the frame. For that purpose, the base 25 may be manufactured with transverse slots for receiving the screws 26, thereby enabling the bearing guide bracket to be slid transversely relative to the screws 26 and frame member 15. When proper transverse adjustment has been attained, the base is tightly fastened to the horizontal frame member 15 by the screws 26 and nuts 27. When the bearing guide bracket with the guide rollers is in the correct transverse location relative to the wheel to properly guide the carriage along the rails, the anti-tip arm hook 47 automatically attains the proper spacial relationship with the rail groove 49.

Thus, it is apparent that there has been provided, in accordance with the invention, an anti-tip device which fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An anti-tip device for preventing tipping of a first member movable along a second member relative to the second member comprising:

a. arm means defining a hook and pivotablly mounted to the first member for selective pivoting between an operative mode wherein the arm means hook movably engages a reaction surface in the second member to prevent tipping and an inoperative mode wherein the arm means is acted upon by gravity to hang open with the hook clear of the second member reaction surface to permit assembly of the first member to the second member; and b. locking means for selectively locking the arm means to the first member in the operative mode and for unlocking the arm means to hang open in the inoperative mode, so that a force tending to tip the first member relative to the second member is resisted by the arm means hook bearing against the reaction surface of the second member when the arm means is in the operative mode.

2. The anti-tip device of claim 1 wherein:

a. the arm means comprises an arm having a first extension and a second extension substantially perpendicular to the first extension, the first extension having an aperture therethrough parallel to the direction of motion of the first member relative to the second member, and the second extension defining the hook, the arm being pivotally mounted to the first member in the region of the junction of the first and second extensions; and b. the locking means comprises a locking pin adapted to be inserted through the aperture in the first arm extension and through an aligned aperture in the first member to prevent pivoting of the arm and thereby place the arm in the operative mode.

3. In a mobile storage system having a carriage and a plurality of wheels mounted thereon for rolling the carriage longitudinally along a fixed path, at least one anti-tip device for preventing tipping of the carriage comprising:

a. a plurality of rails for supporting the carriage wheels, each rail defining a longitudinal groove having an undercut surface;

b. bracket means for mounting to the carriage and defining an aperture therethrough having a longitudinal axis parallel to the direction of carriage motion;

c. an anti-tip arm pivotally mounted to the bracket means for pivoting in a plane transverse to the direction of carriage motion along the rails, the anti-tip arm being formed with a first extension defining an aperture therethrough alignable with the aperture in the bracket means and a second extension defining a hook adapted to slide within the rail groove proximate the rail undercut surface when the arm and bracket means apertures are aligned; and d. a locking pin selectively insertable through the aligned apertures in the bracket means and arm first extension to thereby render the anti-tip arm operative by preventing the arm from pivoting about the bracket means and removable from the arm and bracket means apertures to thereby render the anti-tip arm inoperative by permitting the arm to pivot relative to the bracket means, so that when the anti-tip arm is in the operative mode a force tending to tip the carriage is resisted by the arm hook bearing against the rail undercut surface.

4. The mobile storage system of claim 3 wherein the bracket means includes a pivot pin attached thereto for pivotally supporting the anti-tip arm, the longitudinal axis of the pivot pin being parallel to the direction of carriage motion along the rails.

5. The mobile storage system of claim 3 wherein the anti-tip arm first and second extensions join at substantially right angles, and wherein the arm is pivotally mounted to the bracket means at the junction of the first and second extensions.

6. The mobile storage system of claim 5 wherein:

a. the first extension is substantially horizontal when the anti-tip arm is in the operative mode with the locking pin inserted through the aligned arm and bracket means apertures; and b. the first and second extensions hang downwardly at angles to the horizontal and vertical directions when the anti-tip arm is in the inoperative mode with the locking pin removed from the arm and bracket means apertures, so that the carriage may be placed on the rails when the anti-tip arm is in the inoperative mode and subsequently the anti-tip arm may be rendered operative by inserting the locking pin through the aligned bracket means and arm apertures.

7. The mobile storage system of claim 3 or claim 6 wherein the bracket means includes guide means for transversely guiding the carriage along the rails.

8. The mobile storage system of claim 7 wherein the anti-tip pivots relative to the bracket means about a point having a predetermined spacial relationship to the guide means, so that the guide means thransversely guides the carriage along the rails the anti-tip arm hook is automatically alligned with the rail groove undercut surface.

9. The mobile storage system of claim 7 wherein:

a. the bracket means is formed with a base portion for attaching the bracket means to the carriage, a leg portion extending at a right angles from the base portion and defining the aperture for aligning with the anti-tip arm aperture for receiving the locking pin, and a ledge portion extending at right angles from the leg portion; and b. the guide means comprises a pair of guide rollers attached to the bracket means ledge portion with the axes of rotation thereof vertical, the guide rollers being transversely spaced to accept the rail therebetween for guiding the carriage therealong.

10. A method of assembling a wheel storage system carriage to a longitudinally grooved rail for rollingly supporting the carriage therealong comprising the steps of:

a. providing an anti-tip arm having a hooked extension and a second extension joined to the hooked extension at substantially right angles thereto;

b. mounting the anti-tip arm at the junction of the hooked and second extensions to the carriage to pivot about a horizontal axis in a plane transverse to the direction of carriage motion along the rail in an inoperative mode wherein gravity acts on the arm to cause the hook to hang clear of the rail;

c. placing the carriage wheel upon the rail d. pivoting the anti-tip arm from the inoperative mode to an operative mode wherein the anti-tip arm hook enters into sliding relationship with the rail groove; and e. pinning the anti-tip arm to the carriage in the operative mode, so that the hook reacts with the rail groove to prevent the carriage from tipping relative to the rail.

11. The method of claim 11 comprising the further step of transversely aligning the carriage wheel to the rail and simultaneously and automatically aligning the anti-tip arm to the rail groove.

* * * * *